United States Patent [19]

Lim

[11] Patent Number: 5,075,663

[45] Date of Patent: Dec. 24, 1991

[54] NOISE-SHIELDED TRANSFORMER

[75] Inventor: Seok G. Lim, Inchon, Rep. of Korea

[73] Assignee: Goldstar Electric Machinery Co. Ltd., Seoul, Rep. of Korea

[21] Appl. No.: 607,294

[22] Filed: Oct. 30, 1990

[30] Foreign Application Priority Data

Oct. 31, 1989 [KR] Rep. of Korea ..... 15885/1989

[51] Int. Cl.[5] ..... H01F 15/04

[52] U.S. Cl. ..... 336/69; 336/84 C; 336/229

[58] Field of Search ..... 336/84 C, 84 R, 229, 336/84 M, 69, 70

[56] References Cited

U.S. PATENT DOCUMENTS

| | | | |
|---|---|---|---|
| 1,129,465 | 2/1915 | Fortescue | 336/84 C |
| 3,292,127 | 12/1966 | Dormaier | 336/84 C |
| 3,406,364 | 10/1968 | Russell et al. | 336/84 C X |
| 3,458,843 | 7/1969 | Lord | 336/84 C |
| 4,833,436 | 5/1989 | Martin et al. | 336/229 X |

*Primary Examiner*—Thomas J. Kozma

*Attorney, Agent, or Firm*—Ostrolenk, Faber, Gerb & Soffen

[57] ABSTRACT

A noise-shielded transformer which suppresses electrical noises by absorbing conductible electrical noises that flow into the power line to cause interference, consisting of a gapless-type toroidal core, a primary winding and a secondary winding uniformly wound after dividing the entire magnetic path of the toroidal core in two, and conductive plates mounted to wrap the primary winding and secondary winding, respectively, wherein conductive plates are mounted in the gap of the toroidal core to magnetically isolate the primary winding and the secondary winding, conductive plates are mounted outside the gap of the toroidal core and the gapless-type toroidal core has a configuration of continuously winding steel shield of directional silicon.

2 Claims, 2 Drawing Sheets

NOISE-SHIELDED TRANSFORMER

BACKGROUND OF THE INVENTION

The present invention relates to a transformer which shields electrical noises, more especially to a noise-shielded transformer which suppresses electrical noises by absorbing conductible electrical noises that flow into the power line to cause interference. A noise-generating device becomes a noise source to other peripheral electronic devices and the electrical noises from such a device, which is one of the power line disturbance, is regulated as an electromagnetic interference since the electrical noises have a bad effect on other peripheral electronic devices.

Electronic devices, which are not noise-generating sources, is regulated by electromagnetic susceptibility since such electronic devices are subject to a software malfunction or a hardware breakdown due to external electrical noises.

Accordingly, measures against the electrical noises are required for reliability enhancement and lifetime protection of various electronic devives. That is, a noise-shielded transformer is required which can prevent electrical noises generated by a noise-making device from flowing into other peripheral devices in order to protect them and also protect devices used as loads against external noises.

FIG. 3 is a plain view showing a conventional noise-shielded transformer. As shown in FIG. 3, the conventional noise-shielded transformer has a configuration that a predetermined number of turns of wire is wound around both the left and the right of the cut-core or the U-I iron core 1 for the primary winding 2 and the secondary winding 3, these windings of the primary 2 and the secondary 3 are covered with insulators 4*a*, 4*b* for an electrical insulation, conductive plates 5*a*, 5*b* are wrapped over the insulators 4*a*, 4*b*, conductive plates 6, 7 are mounted amidst said iron core 1 in order to magnetically isolate said primary winding 2 and secondary winding 3, the terminals of said primary winding 2 are connected to an alternate power source, and the terminals of said secondary winding 3 are connected to a load 8.

In the conventional noise-shieled transformer having such a configuration, when an alternate power source including a pulse-property noise flows into the primary winding 2, the pulse-property noise generates magnetic flux of a high frequency with flowing in the primary winding 2, wherein the iron core 1 minimizes the magnetic flux of a high frequency generated by the pulse-property noise since the iron core 1 made of the material sharply decreasing the magnetic permeability over high frequencies is used for low frequencies.

Accordingly, a noise induction in the secondary winding 3 is minimized since the useful magnetic flux caused by the high frequency noise flowing into the primary winding 2 is minimized.

In the meantime, the conductive plates 5*a*, 5*b* prevent a noise induction from being generated by the influence of external electric and magnetic fields on the primary and secondary windings 2, 3, the radiation of a high frequency noise flowing into the primary winding 2, and the noises conducted past the capacitance between the primary and secondary windings 2, 3 since the conductive plates 5*a*, 5*b* are grounded to reduce the capacitance between the primary and secondary windings 2, 3 and by-pass the noises to the ground. And also, the conductive plates 6, 7 magnetically isolate the primary and secondary windings 2, 3 in order for their interference to be blocked, and minimize the capacitance between the primary and secondary windings 2, 3.

In particular, the conductive plates 5*a*, 5*b* suppress noises because the plates generate a large reverse excitation power against a high frequency noise to suppress the useful magnetic flux due to the noise just like the case that the magnetic characteristic change of the iron core 1 is used. However, such a conventional transformer has drawbacks in that its productivity is low since its insulating process and assembly are difficult by using the cut-core or U-I core when constructing its magnetic circuit, its magnetic circuit is apt to have a bad effect on other devices because a very high leakage of magnetic field is made by its configuration, its voltage change rate which is one important characteristic of a transformer goes very bad, its noise eliminating capability becomes bad by the effect of the leakage of the magnetic flux over a range of frequency beyond 100 KHz, a smaller and lighter transformer can not be made because the configuration of its magnetic circuits makes a high magnetic flux design impossibe, and its efficiency is lowered.

SUMMARY OF THE INVENTION

The object of the present invention is to provide a noise-shielded transformer which enhances its workability, suppresses its leaking magnetic flux, and performs its high magnetic flux operation in order to remove the conventional drawbacks described above.

The object of the present invention is attained by:

dividing a toroidal core in two with a predetermined space, winding wire around the two and insulators on the two by a predetermined number of turns for the primary and secondary windings, wrapping the primary and secondary windings and insulators on the windings with conductive plates, and mounting conductive plates for magnetically isolating said primary and secondary windings.

DETAILED DESCRIPTION OF THE INVENTION

A detailed description of the present invention will be given in detail below with reference to the accompanying drawings.

Figure 1:
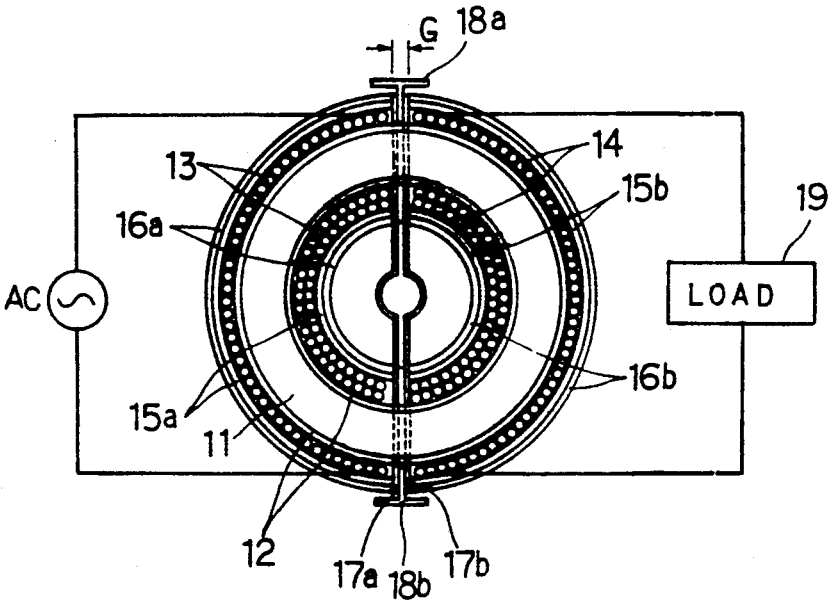
FIG. 1 is a plan view showing a nose-shielded transformer according to the present invention.

FIG. 1 is a plan view showing a noise-shielded transformer according to the present invention. As shown in FIG. 1, the noise-shielded transformer has a configuration that a gapless-type toroidal core 11 is divided in two with a predetermined gap G, a predetermined number of turns of a primary and a secondary windings 13, 14 are uniformly wound around the two through an insulator 12, insulators 15*a*, 15*b* are wrapped around the primary and secondary windings 13, 14 for an electrical insulation and then conductive plates 16*a*, 16*b* are wrapped over the insulators 5*a*, 15*b*, conductive plates 17*a*, 17*b* and 18*a*, 18*b* are mounted in and out of said gap G of the toroidal core 11, respectively, for magnetically isolating said primary and secondary windings 13, 14, an alternate power source AC is connected to the terminals of said primary winding 13 and a load 19 is connected to the terminals of said secondary winding 14, wherein said gapless-type toroidal core 11 has a configuration that steel sheet of directional silicon is continuously wound.

Figure 2A:
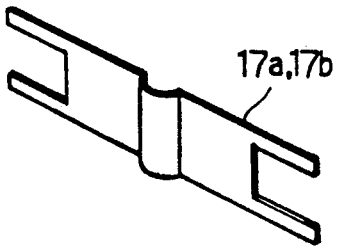
FIGS. 2A and 2B are perspective veiws of conductive plates in FIG. 1.
Figure 2B:
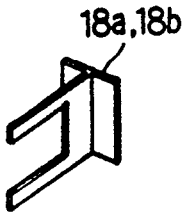
Figure 3:
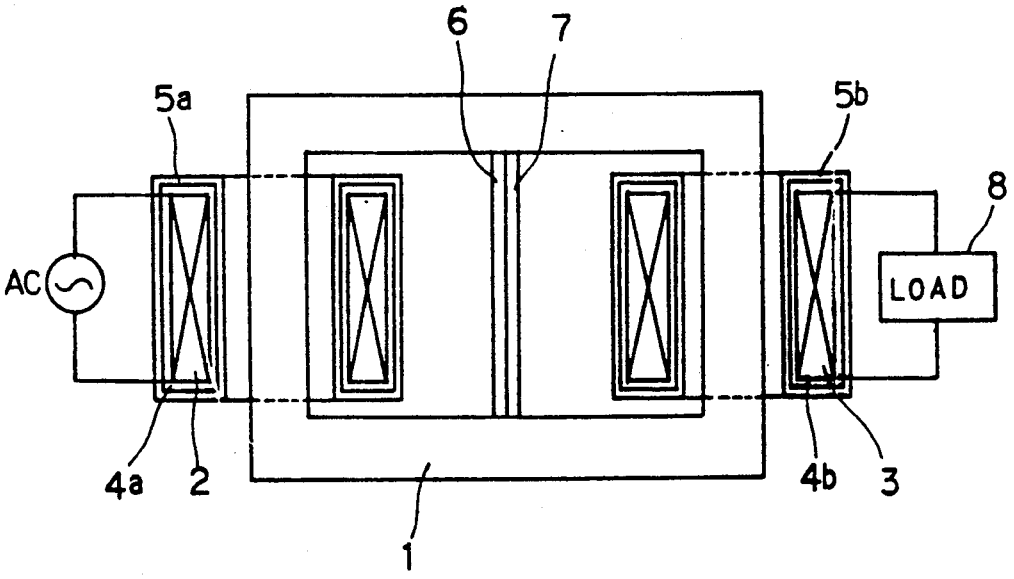
FIG. 3 PRIOR ART
FIG. 3 is a plan view showing a conventional noise-shielded transformer.

FIG. 2A is a perspective view of conductive plates 17*a*, 17*b*, and FIG. 2B is a perspective view of conductive plates 18*a*, 18*b*.

The operations and effects of the present invention having such a configuration will be described in detail below.

An alternate power source flowing into the primary winding 13 along with a noise generates a noise current in the primary winding 13 which induces a noise in the secondary winding 14.

However, at this time, the toroidal core 11 is for low frequency and thus the noise magnetic flux of high frequency maximizes a magnetro-resistance over high frequencies to minimize an effective noise, so that a noise energy is absorbed as a loss of the toroidal core 11.

According to this, any high frequency flowing in the primary winding 13 is not induced in the secondary winding 14.

And also, the gapless-type toroidal core 11 has an enhanced noise eliminating capability due to its sensitivity to magnetic permeability over a high frequency noise.

And also, when a high frequency noise flows into the primary winding 13, the conductive plates 16*a*, 16*b* generate a corresponding current of a reverse electromotive force against the high frequency nose to minimize the magnetic flux due to said high frequency noise, thereby enhancing the noise shield effect much more.

And also, the conductive plates 16*a*, 16*b* minimize the capacitance between the primary and secondary windings 13, 14 to block conducting of the noise caused by the capacitance.

And also, the conductive plates 17*a*, 17*b* and 18*a*, 18*b* mounted in and out of the toroidal core 11, respectively, minimize the capacitance between the primary and secondary windings 13, 14 much more along with the conductive plates 16*a*, 16*b* to surely prevent a noise induction by the capacitance.

And also, since the conductive plates 16*a*, 16*b* is grounded to by-pass the magnetic field leaked from the toroidal core 11 as well as the electric and magnetic fields invaded from the external which exert influence on the primary and secondary windings 13, 14, thereby making no noise induction. And also, the primary and secondary windings 13, 14 uniformly surround the entire magnetic path of the toroidal core 11 to lessen the occurrence of the leakage of the magnetic flux, thereby reducing the influence on other electronic devices and getting a satisfactory noise eliminating characteristic as well as a satisfactory voltage change rate which is an important characteristic of a transformer.

And also, the use of the toroidal core 11 allows a higher occupation of the primary and secondary windings 13, 14 on the entire magnetic path to increase the leakage of the reactance so that the influence of the leaking reactance at high frequencies becomes less.

In addition, a very small capacitance between the primary and secondary windings 13, 14 shielded with the conductive plates 16*a*, 16*b*, 17*a*, 17*b*, 18*a*, 18*b* permits an outstanding capability in removing the noise caused by the components of a common mode and a differential mode.

Mounting a "□" shaped insulator, which is not shown in the drawings and mounted at the gap G of the toroidal core 11 isolating the primary and secondary winding 13, 14, that is, at the place where the conductive plates 17*a*, 17*b*, 18*a*, 18*b* are mounted in the toroidal core, 11, enables the assembly workability to be enhanced as well as the insulating gap to be secured after the assembling is finished.

As described above in detail, the present invenion has the effects that a bad influence on other electronic devices is reduced by suppressing the occurrence of the leakage of the magnetic flux by the use of the toroidal core, the insulating process is made easy and the assembly workability is outstanding with the configuration using the toroidal core, the high occupation of the primary and secondary windings on the entire magnetic path of the toroidal core makes the leakage of the reactance low, satisfactory voltage change rate and efficiency is achieved since the gapless-type toroidal core enables the high frequency magnetic flux operation to be made, a smaller and lighter configuration is possible due to the directional gapless-type iron core, and the noise eliminating capability is outstanding because a low leakage of the reactance makes a small amount of a bad influence at high frequencies.

What is claimed is:

1. A noise-shielded transformer comprising: a gapless toroidal core in a plane; first conductive plate members extending perpendicular to said plane across the toroidal core, said plate members being spaced apart to form a gap, the toroidal core being divided into first and second core portions which are on opposite sides of the gap;

a primary winding uniformly wound on the first portion of the toroidal core;

a secondary winding uniformly wound on the second portion of the toroidal core;

second conductive plate members covering the primary winding and the secondary winding, respectively; and third conductive plate members each having an outer portion mounted outside of the gap formed by the first conductive members, the outer portions being transverse to the first conductive plate members and being mounted opposite to and spaced from the gap formed by the first conductive plate members, said third conductive plate members each having an inner portion extending into the gap, said first conductive plate members and said third conductive plate members cooperating to form a continuous conductive shield between said primary winding and said secondary winding.

2. A noise-shielded transformer as in claim 1 wherein said gapless-type toroidal core has a configuration of continuously winding steel sheet of directional silicon.

* * * * *